US006002117A

United States Patent [19]

Pak

[11] Patent Number: 6,002,117

[45] Date of Patent: Dec. 14, 1999

[54] ELECTRIC HEATING CORD WITH NON-HEATING CORE-CONDUCTING ELEMENT AND REDUCED EMF EMISSIONS

[76] Inventor: Il Young Pak, 2538 Carlton Pl., Rowland Heights, Calif. 91748

[21] Appl. No.: 09/038,359

[22] Filed: Mar. 10, 1998

[51] Int. Cl.[6] ..... H05B 1/00; H05B 3/02

[52] U.S. Cl. ..... 219/549; 219/212; 219/528; 219/544; 219/547

[58] Field of Search ..... 219/211, 212, 219/547, 549, 527, 528, 542, 543, 544; 604/113

[56] References Cited

U.S. PATENT DOCUMENTS

| | | | |
|---|---|---|---|
| 3,621,203 | 11/1971 | Geominy et al. | 219/549 |
| 3,646,322 | 2/1972 | Speekman | 219/549 |
| 3,657,520 | 4/1972 | Ragault | 219/549 |
| 3,784,784 | 1/1974 | Geominy et al. | 219/549 |
| 4,309,597 | 1/1982 | Crowley | 219/549 |
| 4,684,785 | 8/1987 | Cole | 219/212 |
| 4,742,212 | 5/1988 | Ishii et al. | 219/549 |
| 4,792,663 | 12/1988 | Kishimoto et al. | 219/549 |
| 4,910,391 | 3/1990 | Rowe | 219/549 |
| 5,206,485 | 4/1993 | Srubas et al. | 219/549 |
| 5,394,507 | 2/1995 | Okamoto . | |
| 5,521,358 | 5/1996 | Eilentropp | 219/549 |

FOREIGN PATENT DOCUMENTS 404278125A 10/1992 Japan .

*Primary Examiner*—Mark Paschall
*Assistant Examiner*—Fadi H. Dahbour
*Attorney, Agent, or Firm*—Eugene Oak

[57] ABSTRACT

A heating cord utilizes a non-heating core conductor that is wrapped with a high temperature insulator. The high temperature insulator is wrapped with a heat resistant insulator, wherein the heat resistant insulator is spirally wound with a heat generating wire. Finally, an insulation sheath covers entire embodiment forming a heat-generating cord. The core conductor and the heat generating wire are connected, forming a single electronic circuit wherein the electric current flowing along the core conductor flows in the opposite direction of the electric current flowing along the heat generating wire. As a result, the opposing electromagnetic fields generated by the opposing flows of electric current neutralize each other and function to reduce electromagnetic field emissions generally known to be harmful to humans. The present design allows safe operation well above the approximate 100 watt limitation inherent in designs that utilize resistive, heating-generating core elements.

1 Claim, 2 Drawing Sheets

ELECTRIC HEATING CORD WITH NON-HEATING CORE-CONDUCTING ELEMENT AND REDUCED EMF EMISSIONS

BACKGROUND OF THE INVENTION

1. Field of the Invention

The present invention generally pertains to the field of heating cables used for personal comfort products such as heating blankets, heating pads, and the like. More specifically, this invention relates to a type of heating cable with a non-heating core-conducting element, and which reduces EMF emissions when a current is passed through the heating cable.

2. Description of the Prior Art

Electric heating cords have been constructed in such a way as to prevent the adverse influence of electromagnetic and electrostatic fields. Prior art has achieved this by utilizing varying methods of insulation under which a heating wire(s) is wrapped around a resistive core material.

In Japanese Patent No. JP404278125A to Itokawa, a first heat generating wire is spirally wound on a core material and covered with a heat resistant insulator. A second heat generating wire is spirally wound on the insulator and covered with a melting layer. This layer is wound with a sensing wire and insulation sheath to form a heat generator. The core material utilized in this heat generator is resistive and thus functions as a heat emitter. By utilizing a resistive core material, the prior art exhibits significant limitations. Namely, there is an approximate 100 Watt limit of operation as well as the possibility of meltdown of the heat generator components when two parallel heating wires are used in this orientation.

Further prior art has utilized conductive core material. For example, U.S. Pat. No. 5,394,507 to Okamoto discloses a plurality of electrically conductive cores wrapped around a tube through which fluid may flow. Said plurality of cores are each covered with an insulator having exposed portions, allowing said cores to contact a tubular braided structure of resistance heating wire. Unlike the present invention, electric current flowing along the conductive cores flows in the same direction along the braided structure of resistance heating wire. Without opposing electric current flow, subsequent opposing electromagnetic fields are not generated, and the reduction of electromagnetic waves is not accomplished by neutralization between the opposing electromagnetic fields.

SUMMARY OF THE INVENTION

The present invention is a heating cord which effectively emits heat and reduces the amount of electromagnetic field emissions when a current is passed through the heating cord.

The heating cord of this invention comprises a plurality of successive concentric layers of material that are wrapped upon a non-heating core conductor. The core conductor is wrapped with a high temperature insulator. This high temperature insulator is wrapped with a heat resistant insulator, wherein a heat generating wire is spirally wound around said heat resistant insulator. An insulation sheath covers the entire embodiment forming a heat-generating cord.

The core conductor and the heat generating wire are connected, forming a single electronic circuit, wherein the electric current flowing along the core conductor flows in the opposite direction of the electric current flowing along the heat generating wire. As a result, the opposing electromagnetic fields generated by the opposing parallel flows of electric current neutralize each other and function to reduce the net emission of electromagnetic fields.

BRIEF DESCRIPTION OF THE DRAWINGS

For a better understanding of the principle and nature of the present invention, reference should be made to the following detailed description taken in connection with the accompanying drawings in which.

DETAILED DESCRIPTION OF THE PREFERRED EMBODIMENT

Figure 3:
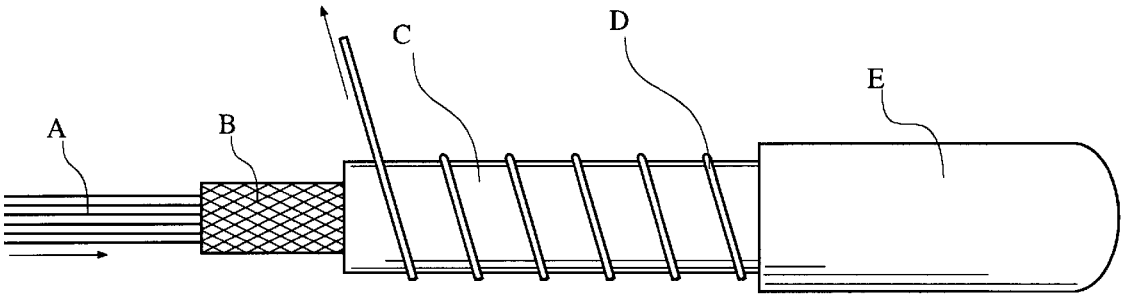
FIG. 3 depicts an internal concentric side view of the heat-generating cord.

Referring to FIG. 3, the present invention comprises a heating cord. The core conductor A is disposed at the center of the heating cord, wherein a plurality of successive concentric layers of material are wrapped upon the core conductor A, forming the heating cord. The core conductor A may be made of conducting material such as annealed copper; however, the core conductor A may not have resistive properties that may cause the generation of heat when a current is passed through the wire.

The core conductor A is covered with a high temperature insulator B. The high temperature insulator B is covered with a heat resistant insulator C, wherein the heat resistant insulator C is spirally wound with a heat generating wire D. The heat generating wire D emits heat when an electric current is passed through the wire D due to the resistive nature of the wire D.

An insulation sheath E, covers the entire embodiment forming the heating cord. Because the insulation sheath E is the outermost layer, it functions as a protective layer between the heat generating wire D and the surroundings of the heating cord. Moreover, the insulation sheath E must also permit the conduction of heat in order for the heating cord to function as a heating cord.

Unique to the present invention is the structure by which both safe operation wattage levels are increased and electromagnetic field emissions are reduced. Heat is not emitted from the non-resistant core conductor A when a current is passed through it. However, as the same electric current is passed through the resistive heat generating wire D, heat is emitted due to the resistance of the wire D. By preventing heat generation from the core conductor A and allowing heat to be emitted only from the heat-generating wire D, the present invention avoids excessive heat emissions and subsequently increases the maximum wattage operation level beyond the approximate 100 watt limit of the prior art to approximately 270 watts.

Figure 1:
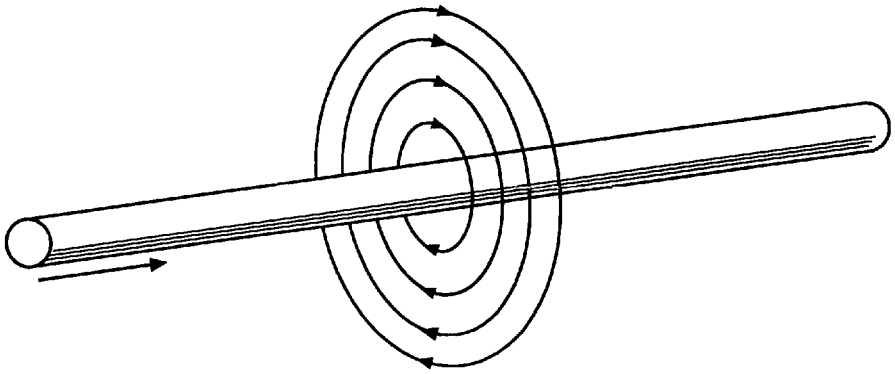
FIG. 1 Prior Art
FIG. 1 depicts a perspective view of the prior art's heat-generating cord and the electromagnetic field generated when electric current flows in a single direction.
Figure 2:
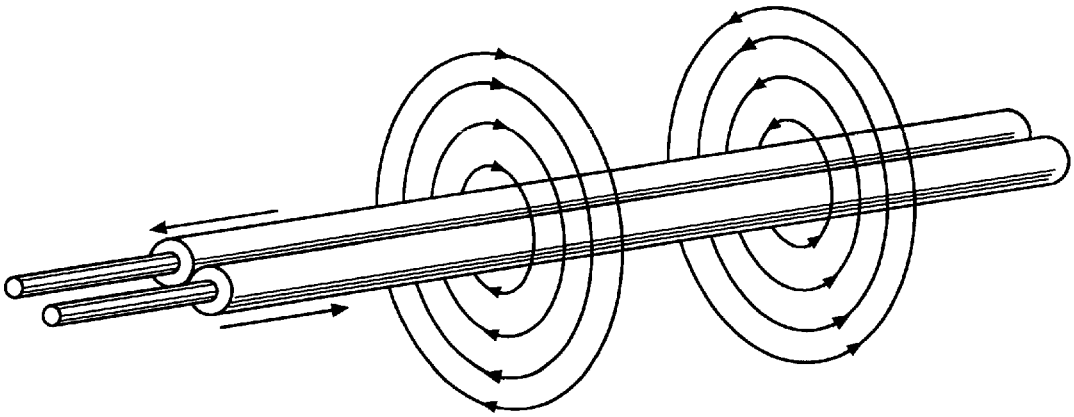
FIG. 2 depicts a perspective view of the heat-generating cord with its opposing electric current flow and subsequently opposing electromagnetic fields.

The non-resistant core conductor A and the resistant heat generating wire D are connected, forming a single electronic circuit, wherein the electric current flowing along the core conductor A flows in the opposite direction of the electric current flowing along the heat generating wire D. Referring to FIG. 1, conventional heating cords emit electromagnetic fields when electric currents flow through the cord in one direction. Referring to FIG. 2, as in the present invention, when electric current flows in opposing parallel directions, two opposing electromagnetic fields are generated. These electromagnetic fields neutralize each other and function to reduce the net emissions of electromagnetic fields.

Application of this invention includes heating cords utilized in personal comfort devices such as heating blankets, heating pads, and the like. The present invention is particularly useful in applications which involve heat generating devices that are used in close contact with humans, since the reduced electromagnetic field emissions of the present invention provide a safer heating device.

What is claimed as being new and therefore desired to be protected by letters patent of the United States is the following:

1. A heating cord comprising:

a) a non-resistive core conducting element;

(1) wherein said non-resistive core conducting element does not emit heat;

(2) wherein said non-resistive core conducting element is oriented longitudinally within said heating cord;

b) a high temperature insulator wrapped upon said non-resistive core conducting element;

c) a heat resistant insulator wrapped upon said high temperature insulator;

d) a resistive heat generating wire;

(1) wherein said resistive heat generating wire is spirally wound upon said heat resistant insulator;

(2) wherein said resistive heat generating wire is longitudinally wound with respect to said heating cord;

(3) wherein said core conducting element and said resistive heat generating wire are connected to form a single electronic circuit;

(a) wherein when a current is passed through said electronic circuit, said current flowing in said resistive heat generating wire flows in an opposite direction with respect to said current flowing in said core conducting element;

(b) wherein EMF emissions are offset by said current flowing in opposite directions in said resistive heat generating wire and said core conducting element;

e) an insulation sheath wrapped upon said resistive heat generating wire and said heat resistant insulator.

* * * * *